US011431130B2

(12) United States Patent
Yang

(10) Patent No.: US 11,431,130 B2
(45) Date of Patent: Aug. 30, 2022

(54) ELECTRICAL CONNECTOR ASSEMBLY WITH METALLIC CAGE HAVING ELASTIC GROUNDING FINGERS AROUND THE MOUNTING PORTION

(71) Applicant: Molex, LLC, Lisle, IL (US)

(72) Inventor: Che-Yuan Yang, New Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/935,203

(22) Filed: Jul. 22, 2020

(65) Prior Publication Data

US 2021/0028580 A1 Jan. 28, 2021

(30) Foreign Application Priority Data

Jul. 24, 2019 (CN) ..... 201910668933.0

(51) Int. Cl.

| | |
|---|---|
| ***H01R 13/6581*** | (2011.01) |
| ***H01R 13/6594*** | (2011.01) |
| *H01R 13/6591* | (2011.01) |
| *H01R 13/658* | (2011.01) |
| *H01R 13/6595* | (2011.01) |

(Continued)

(52) U.S. Cl.

CPC ..... *H01R 13/6581* (2013.01); *H01R 13/6594* (2013.01); *H01R 12/716* (2013.01); *H01R 13/648* (2013.01); *H01R 13/658* (2013.01); *H01R 13/6591* (2013.01); *H01R 13/6595* (2013.01)

(58) Field of Classification Search

CPC ..... H01R 13/6581; H01R 13/6594; H01R 13/6591; H01R 13/658; H01R 13/6595; H01R 13/648; H01R 12/716

See application file for complete search history.

(56) References Cited

U.S. PATENT DOCUMENTS

| | | | |
|---|---|---|---|
| 5,433,633 | A | 7/1995 | Matsumoto et al. |
| 9,893,472 | B1 | 2/2018 | Chen |

(Continued)

FOREIGN PATENT DOCUMENTS

| | | | |
|---|---|---|---|
| CN | 100481643 | C | 4/2009 |
| CN | 104332769 | A | 2/2015 |

(Continued)

OTHER PUBLICATIONS

Office Action received for CN Application 201910668933.0, dated Aug. 27, 2021, 17 Pages (09 Pages of English translation and 08 Pages of Official notification).

(Continued)

*Primary Examiner* — Abdullah A Riyami
*Assistant Examiner* — Justin M Kratt

(57) ABSTRACT

A connector assembly includes a metal shielding cage. The metal shielding cage includes a cage body, a back cover and a grounding member. The cage body has a top wall, a mounting side and two side walls, the top wall, the mounting side and the two side walls together define a receiving space extending along a front-rear direction, the receiving space has a front opening toward the front and a rear opening positioned at the rear, the back cover and the grounding member are assembled at the rear opening of the cage body, and the grounding member is provided with an elastic grounding finger row toward the mounting side.

12 Claims, 7 Drawing Sheets

(51) Int. Cl.
*H01R 13/648* (2006.01)
*H01R 12/71* (2011.01)

(56) References Cited

U.S. PATENT DOCUMENTS

| | | | | |
|---|---|---|---|---|
| 10,305,227 | B2 | 5/2019 | Wang et al. | |
| 10,840,645 | B2 * | 11/2020 | Briant | H05K 1/181 |
| 10,923,856 | B2 * | 2/2021 | Sharf | H01R 13/645 |
| 2011/0230097 | A1 | 9/2011 | Dunwoody et al. | |
| 2014/0153192 | A1 | 6/2014 | Neer et al. | |
| 2015/0171558 | A1 * | 6/2015 | Yu | H01R 13/405 439/607.01 |

FOREIGN PATENT DOCUMENTS

| | | | |
|---|---|---|---|
| CN | 208782172 | U | 4/2019 |
| TW | 201507294 | A | 2/2015 |
| TW | 201628290 | A | 8/2016 |
| TW | 201733225 | A | 9/2017 |
| TW | 201925979 | A | 7/2019 |

OTHER PUBLICATIONS

Notice of Allowance received for CN Application No. 201910668933.0, dated May 7, 2022, 7 pages (3 pages of English translation and 4 pages of Official copy).

* cited by examiner

ELECTRICAL CONNECTOR ASSEMBLY WITH METALLIC CAGE HAVING ELASTIC GROUNDING FINGERS AROUND THE MOUNTING PORTION

RELATED APPLICATIONS

This application claims priority to Chinese Application No. 201910668933.0 filed on Jul. 24, 2019, which is incorporated herein by reference in its entirety.

TECHNICAL FIELD

The present disclosure relates to a connector assembly, particularly relates to a connector assembly having a metal shielding cage.

BACKGROUND

Chinese invention patent application issuance No. CN100481643C (corresponding to U.S. Pat. No. 7,473,130) discloses a shielding cage; a sheet metal section (a metal shielding shell) of the shielding cage includes a plurality of surface mounted technology (SMT) legs; the surface mounted technology legs are adapted to be soldered on pads of a circuit board; and the surface mounted technology legs are provided too close to each other to keep suitable electromagnetic shielding. However, because the surface mounted technology (SMT) requires higher coplanarity, the surface mounted technology legs, the number of which is large, will cause the difficulty of manufacturing to increase, and surfaces of the surface mounted technology legs may generate an empty soldering or warpage problem during soldering. Moreover, the surface mounted technology legs, the number of which is large, and the sheet metal section are formed as an integral configuration. Because the sheet metal section (the metal shielding shell) generally is required to have higher strength, a thickness of the sheet metal section needs to be thicker and, in this case, a thickness of the surface mounted technology leg is also correspondingly increased. This causes the surface mounted technology leg to not be easily formed, and in turn, the difficulty of manufacturing is increased and the rigidity of the surface mounted technology leg is increased; but if the thickness of the sheet metal section (the metal shielding shell) is decreased, although the surface mounted technology leg can be more easily formed and relatively has elasticity, in this case, the whole strength of the sheet metal section (the metal shielding shell) will also be decreased correspondingly.

SUMMARY

Therefore, an object of the present disclosure is to provide a connector assembly that can improve at least one problem in prior art.

Accordingly, in some embodiments, a connector assembly of the present disclosure comprises a metal shielding cage. The metal shielding cage comprises a cage body, a back cover and a grounding member. The cage body has a top wall, a mounting side and two side walls, the top wall, the mounting side and the two side walls together define a receiving space extending along a front-rear direction, the receiving space has a front opening toward the front and a rear opening positioned at the rear, the back cover and the grounding member are assembled at the rear opening of the cage body, and the grounding member is provided with an elastic grounding finger row toward the mounting side.

In some embodiments, the grounding member and the back cover are two members which are separated from each other and engaged with each other, the grounding member is provided to a bottom side of the back cover, and a thickness of a metal plate forming the grounding member is less than a thickness of a metal plate forming the back cover.

In some embodiments, the grounding member comprises a rear plate and two side plates extending forwardly from the rear plate, the elastic grounding finger row is provided on bottom edges of the rear plate and the two side plates toward the mounting side.

In some embodiments, the mounting side of the cage body has a bottom wall positioned at the front and a bottom opening positioned at the rear, the elastic grounding finger row is positioned at two lateral sides and a rear side of the bottom opening.

In some embodiments, the two side walls and the back cover of the metal shielding cage are provided with a plurality of grounding legs toward the mounting side, the plurality of grounding legs are arranged to space apart from each other, the elastic grounding finger row is positioned outside the plurality of grounding legs.

In some embodiments, the two side plates of the grounding member are assembled to outer sides of the two side walls of the cage body respectively, each side wall has a plurality of inserting portions protruding outwardly, each inserting portion is formed with an inserting hole from the rear to the front, each side plates has a plurality of inserting parts which are recessed inwardly and engage with the plurality of inserting portions respectively, each inserting part has an inserting piece which extends forwardly and inserts into the corresponding inserting hole of the inserting portion.

In some embodiments, the back cover has a rear covering plate provided to the rear opening, an upper covering plate which extends forwardly from a top edge of the rear covering plate and two side covering plates which extend forwardly from two side edges of the rear covering plate respectively, the upper covering plate has an upper plate portion which extends forwardly from the top edge of the rear covering plate and two side plate portions which extend downwardly from two side edges of the upper plate portion respectively.

In some embodiments, the upper covering plate further has guiding edges which extend from front edges of the upper plate portion and the two side plate portions in a manner of turning forwardly and outwardly.

In some embodiments, front ends of the two side plate portions of the upper covering plate extend beyond the two side covering plates, and a distance between the two side plate portions of the upper covering plate is less than a distance between the two side covering plates.

In some embodiments, each side covering plate further has a guiding edge which is positioned at a front edge of each side covering plate and extends in a manner of turning forwardly and outwardly.

The present disclosure at least has the following technical effect: with the elastic grounding finger row of the grounding member which is the assembled-type, the electromagnetic interference (EMI) effect of the metal shielding cage can be enhanced, and under a precondition that the elastic grounding finger row has better elasticity, the thickness and the strength of the cage body of the metal shielding cage are maintained. Moreover, the back cover and the grounding member which are the assembled-type are two members which are separated from each other and engaged with each other, and the thickness of the metal plate forming the grounding member is less than the thickness of the metal plate forming the back cover, similarly, under the precondition that the elastic grounding finger row has better elasticity, thickness and the strength of the back cover can be maintained.

BRIEF DESCRIPTION OF THE DRAWINGS

Other features and technical effects of the present disclosure will be apparent in embodiments referring to the accompanying figures, in which.

DETAILED DESCRIPTION OF THE PREFERRED EMBODIMENTS

Figure 1:
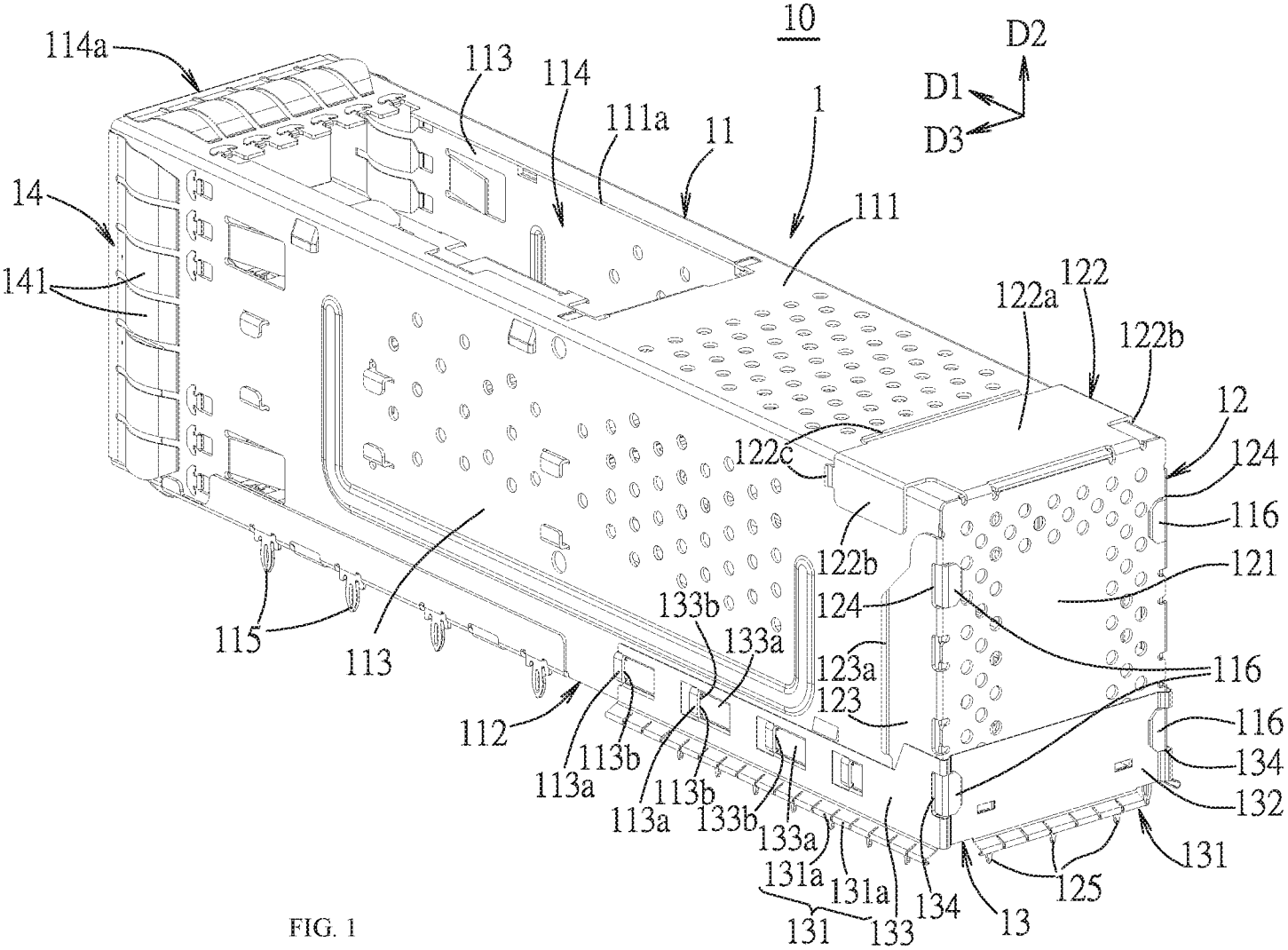
FIG. 1 is a perspective view of an embodiment of a connector assembly of the present disclosure.

Before the present disclosure is described in detail, it should be noted that like elements are denoted by the same reference numerals in the following description.

Figure 2:
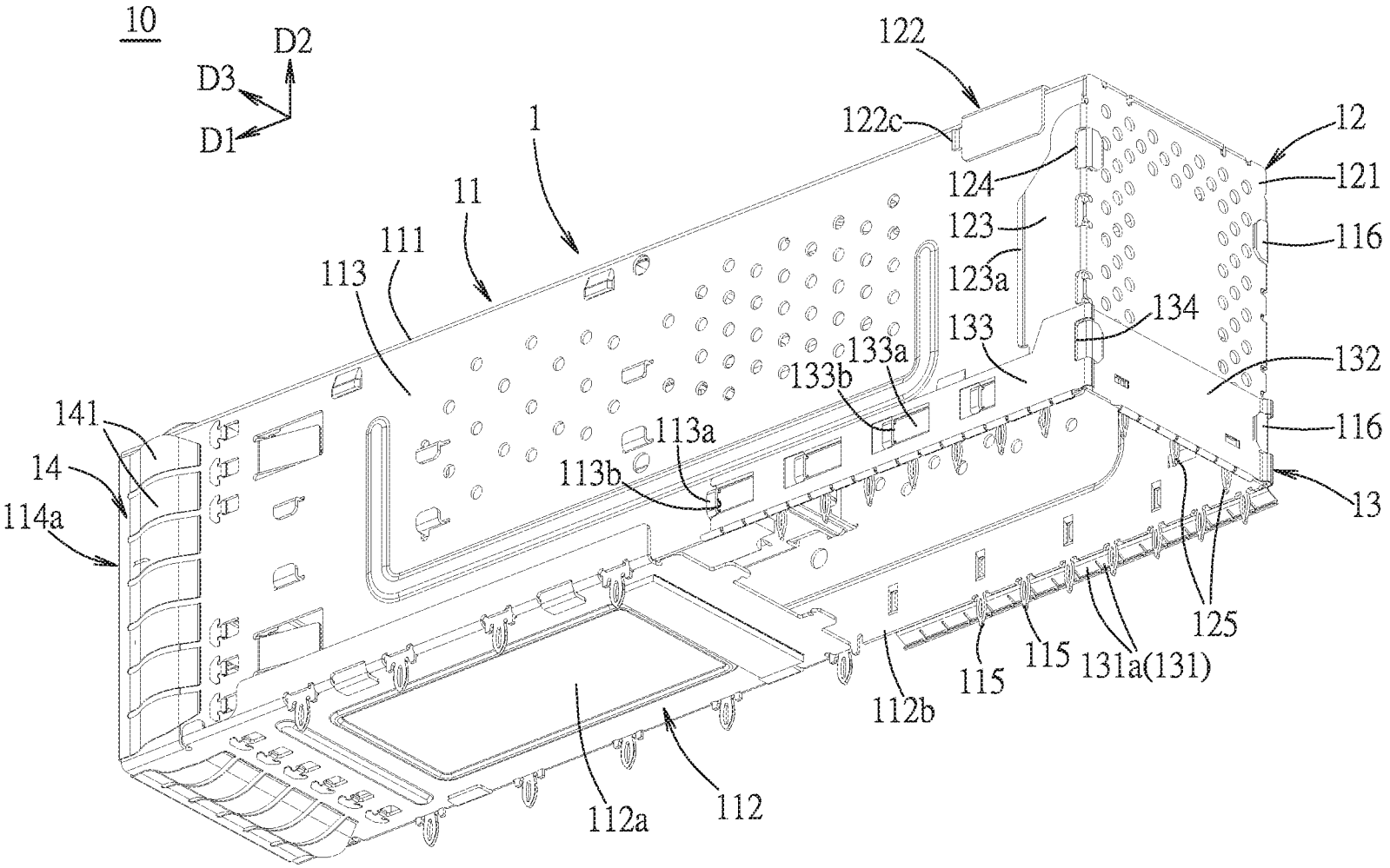
FIG. 2 is a perspective view of the embodiment of FIG. 1 viewed from a different angle and illustrating a mounting side of the embodiment.
Figure 3:
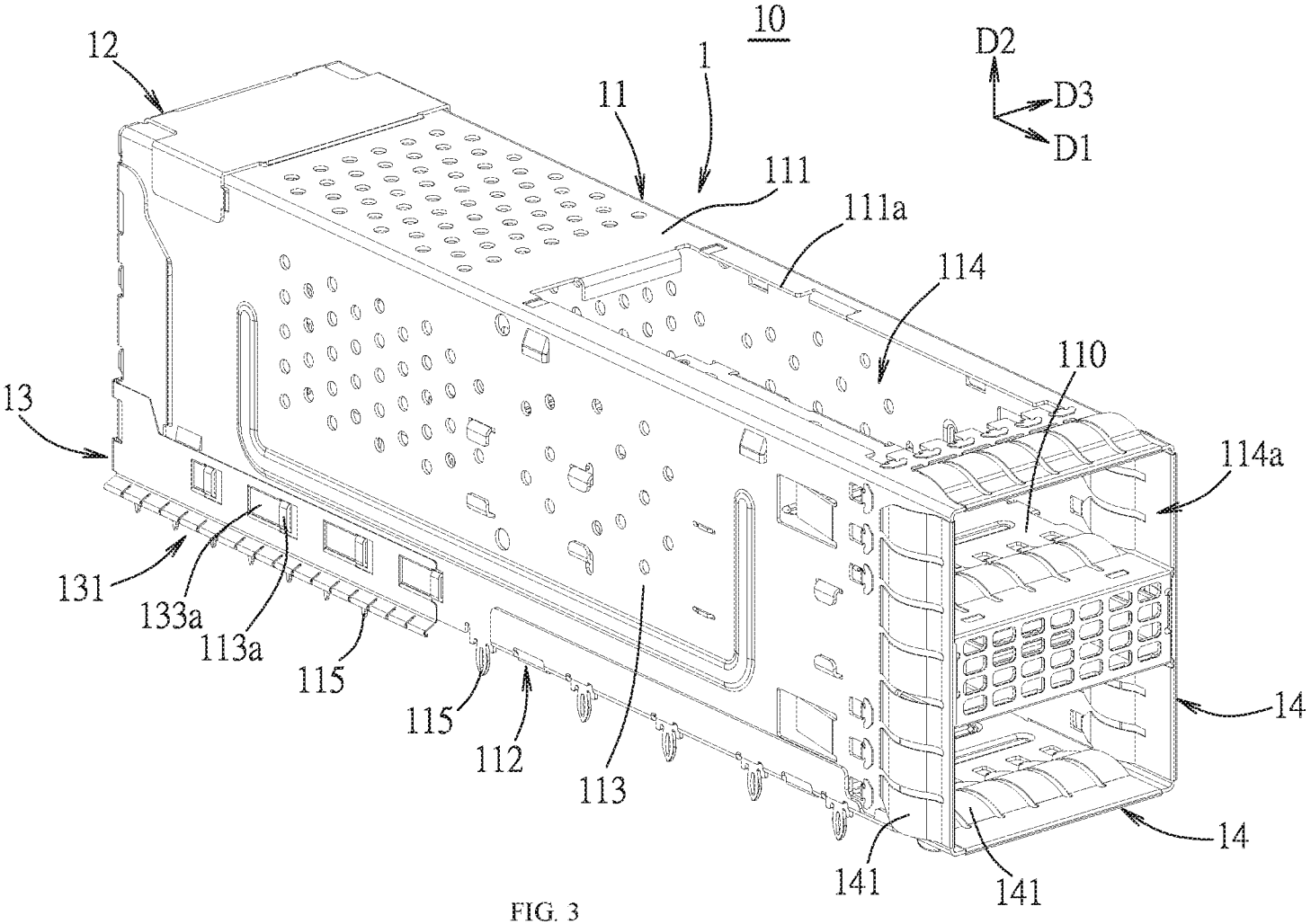
FIG. 3 is a perspective view of the embodiment of FIG. 1 viewed from a different angle and illustrating a front opening of the embodiment.
Figure 4:
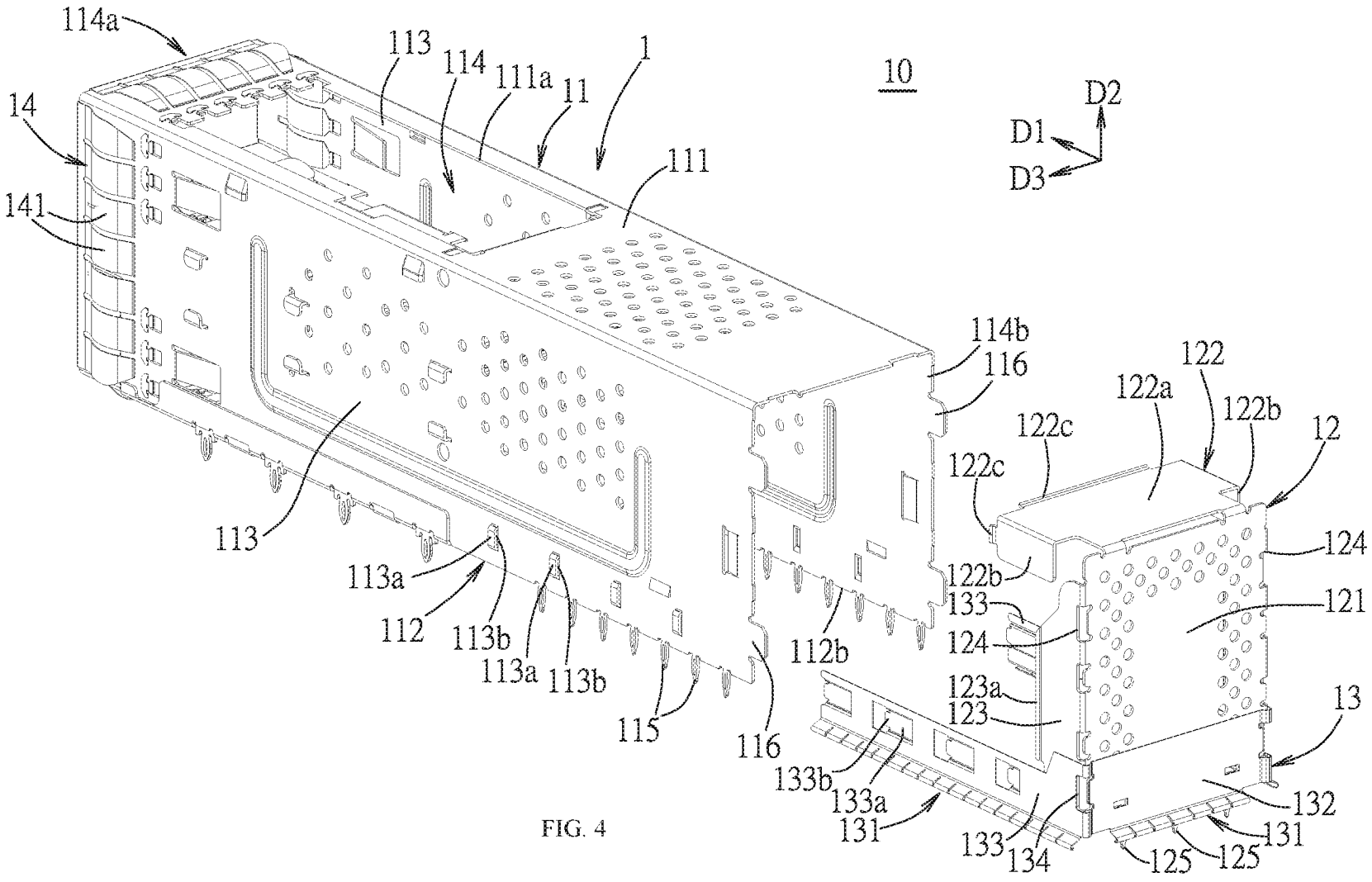
FIG. 4 is an exploded perspective view of FIG. 1.

Referring to FIG. 1 to FIG. 4, an embodiment of a connector assembly 10 of the present disclosure is adapted to allow a plug connector to mate therewith (not shown), the connector assembly 10 includes a metal shielding cage 1 and a receptacle connector (not shown).

The metal shielding cage 1 is formed from a metal plate and includes a cage body 11, a back cover 12 and a grounding member 13. The cage body 11 extends along a front-rear direction D1 and has a top wall 111, a mounting side 112 which is spaced apart from and faces the top wall 111 along an up-down direction D2, and two side walls 113 which are spaced apart from and face each other along a left-right direction D3 and are connected to two sides of the top wall 111 and the mounting side 112 respectively. The top wall 111, the mounting side 112 and the two side walls 113 together define a receiving space 114 extending along the front-rear direction D1, the receiving space 114 has a front opening 114*a* toward the front and a rear opening 114*b* positioned at the rear. In the embodiment, the front opening 114*a* is divided into two front inserting openings in the up-down direction D2 by a spacer 110 which extends along the left-right direction D3 and is connected between the two side walls 113, the two inserting openings respectively allow two plug connectors to be inserted, the spacer 16 may include a configuration, such as a metal plate, a heat sink, a heat pipe and the like, but the present disclosure is not limited thereto. In an embodiment, the metal shielding cage 1 also may not have the spacer 16, that is to say, the receiving space 114 also may only have the front opening as a single front inserting opening. The side walls 113 of the metal shielding cage 1 are provided with a plurality of grounding leg 115 toward the mounting side 112, the plurality of grounding legs 115 are arranged to be spaced apart from each and are adapted to be fixed on a circuit board (not shown) and/or connected to a grounding trace, and the mounting side 112 of the cage body 11 has a bottom wall 112*a* which is positioned at the front and connected to bottom edges of the two side walls 113 and a bottom opening 112*b* which is positioned at the rear and communicated to the receiving space 114. The receptacle connector is connected to a rear segment of the receiving space 114. Specifically, the receptacle connector is mechanically and electrically connected to the circuit board, and the receptacle connector is inserted into the rear segment of the receiving space 114 via the bottom opening 112*b* so as to be covered by the metal shielding cage 1, but the present disclosure is not limited thereto. In addition, the metal shielding cage 1 further includes a plurality of front grounding members 14 provided at the front opening 114*a* of the cage body 11, each front grounding member 14 has a plurality of grounding spring plates 141 which extend rearwardly from a position where the front opening 114*a* is present and are distributed at an outer side of the cage body 11 and an inner side of the cage body 11, the grounding spring plates 141 positioned at the outer side of the cage body are used to contact a case (not shown), the grounding spring plates 141 positioned at the inner side of the cage body 11 are used to contact the plug connector. Moreover, the top wall 111 of the cage body 11 is formed with a top opening 111*a* communicated to the receiving space 114, the top opening 111*a* is used to allow a heat dissipating module (not shown) which will be assembled to the top wall 111 of the metal shielding cage 1 to pass through and enter into the receiving space 114.

Figure 5:
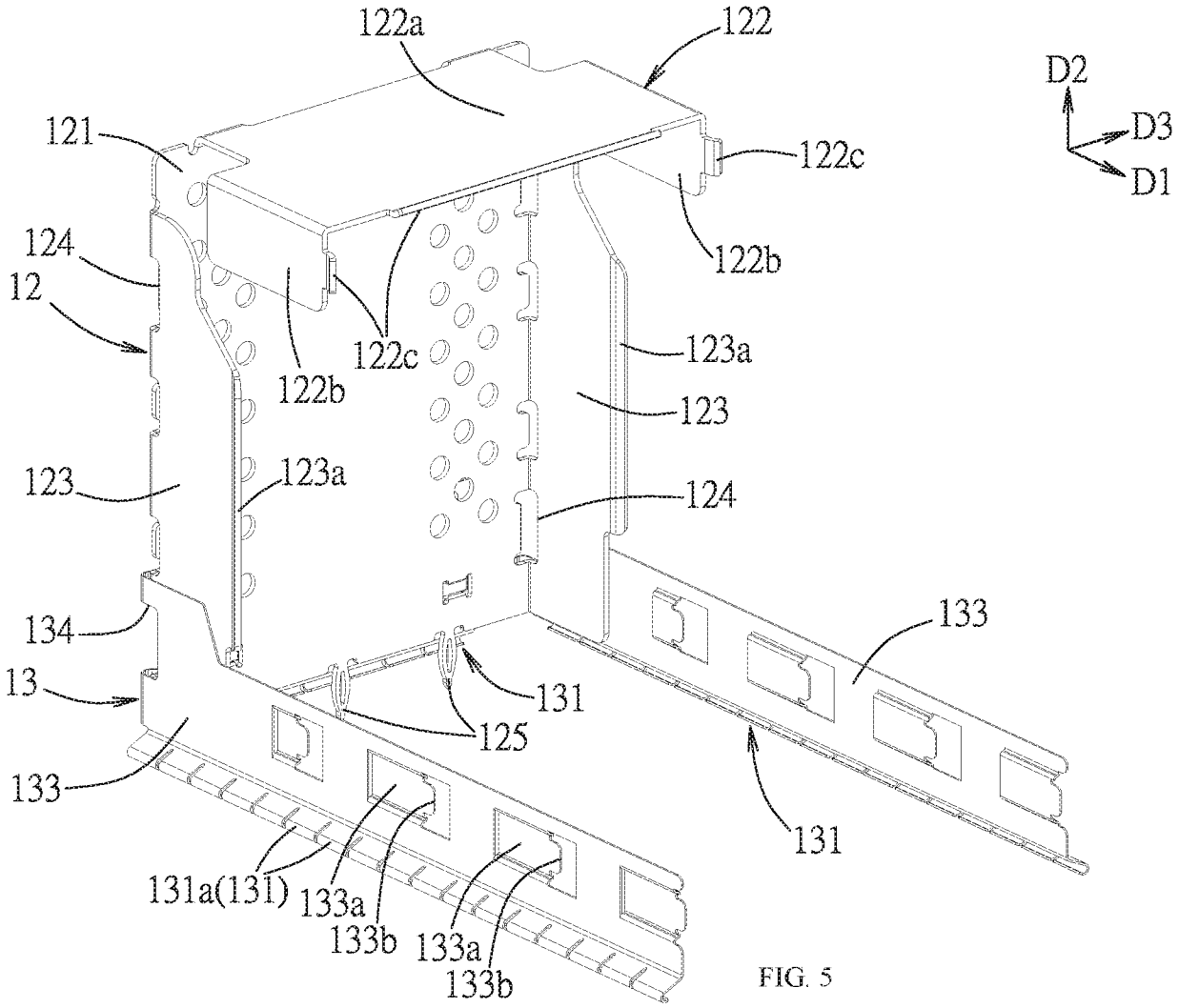
FIG. 5 is a perspective view of a back cover and a grounding member of the embodiment view from the front.
Figure 6:
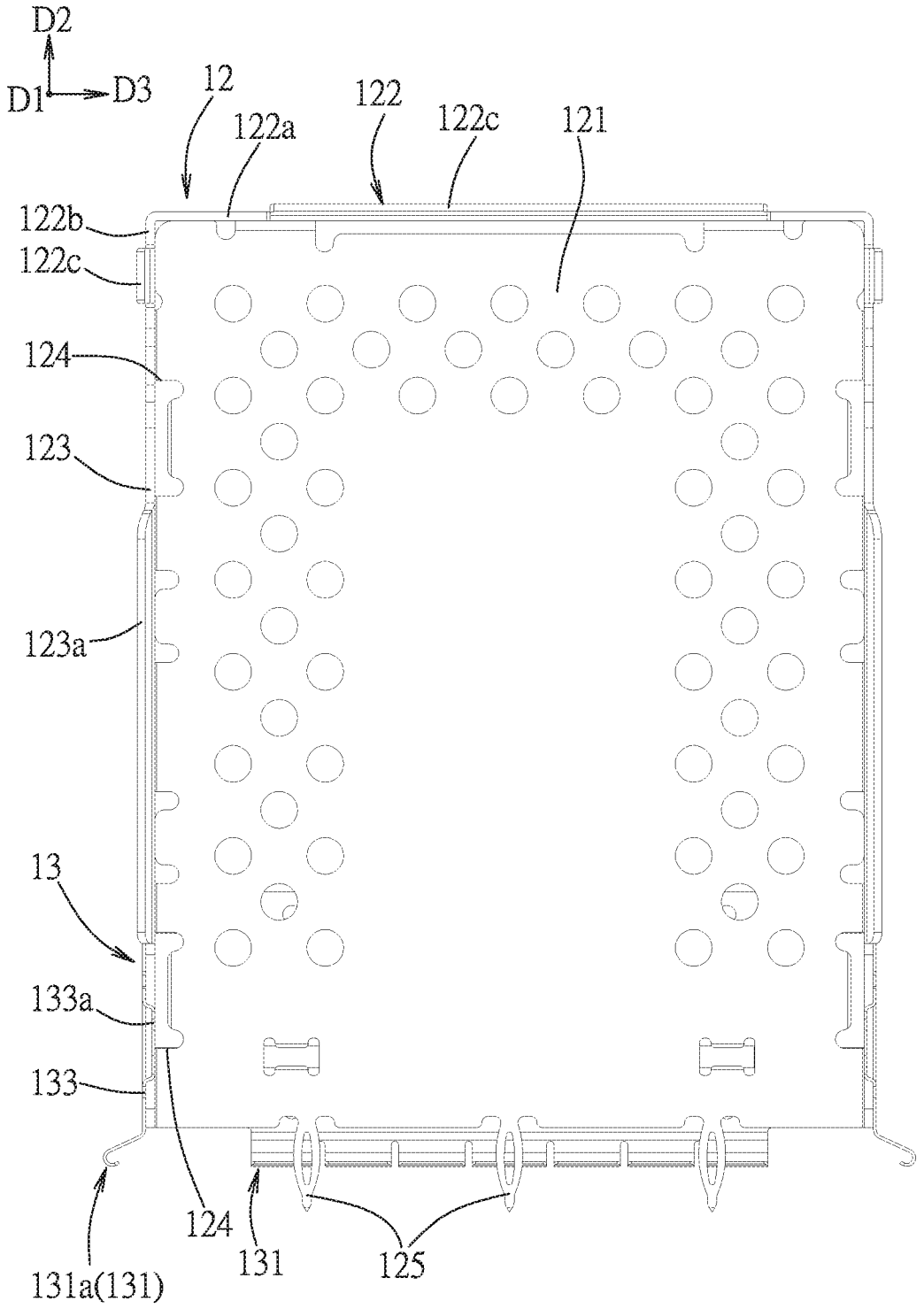
FIG. 6 is a front view of the back cover and the grounding member of the embodiment.
Figure 7:
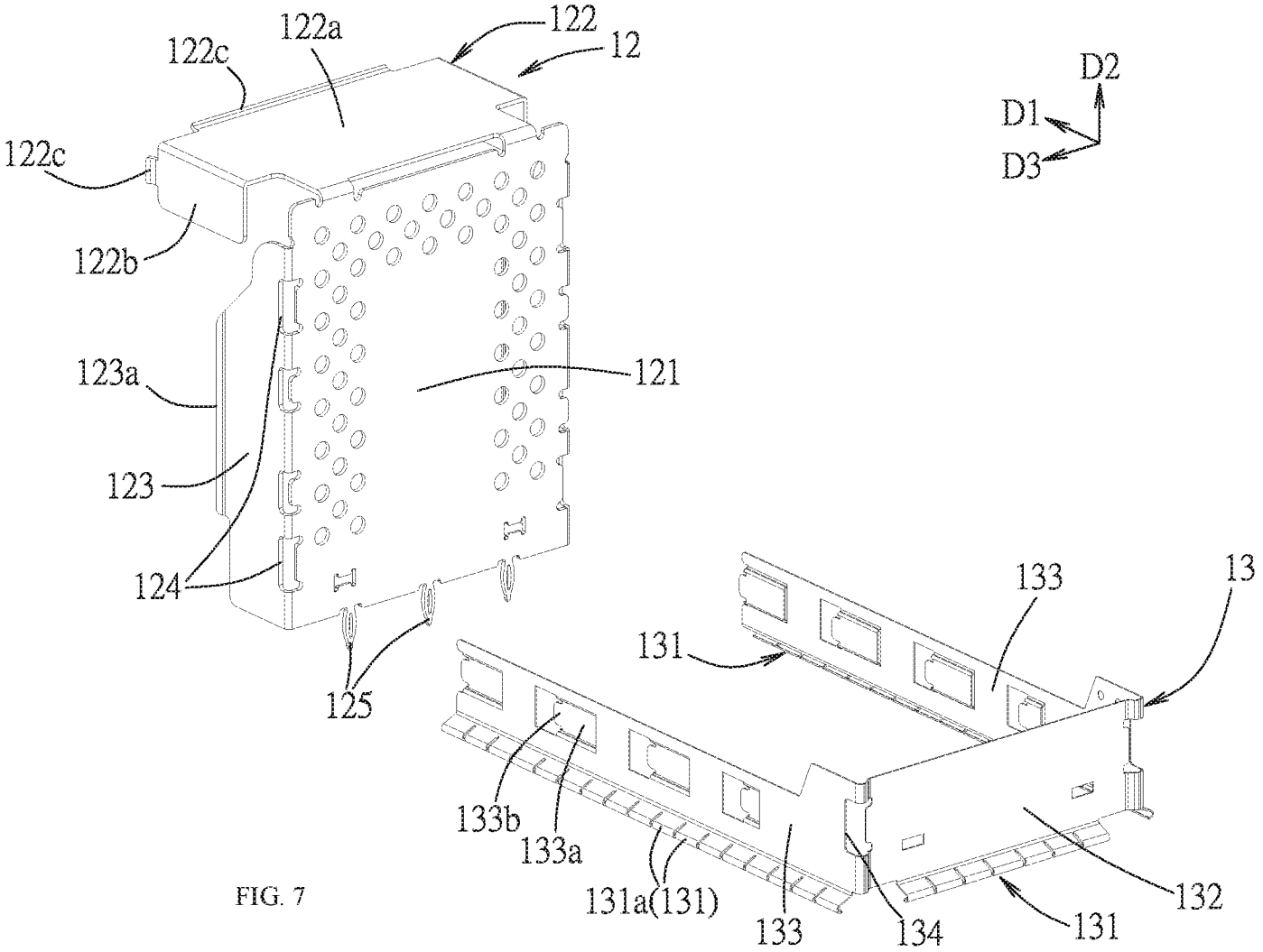
FIG. 7 is a further exploded perspective view of FIG. 4 illustrating the back cover and the grounding member of the embodiment.

Referring to FIG. 1, FIG. 2 and FIG. 4 to FIG. 7, the back cover 12 and the grounding member 13 are assembled at the rear opening 114*b* of the cage body 11, and the grounding member 13 is provided with an elastic grounding finger row 131 toward the mounting side 112, the elastic grounding finger row 131 has elasticity and is used to elastically contact a grounding pad (not shown) of the circuit board, the elastic grounding finger row 131 has a plurality of elastic grounding fingers 131*a* which are closely arranged as a row. A thickness of a metal plate forming the grounding member 13 is less than a thickness of the metal plate forming the cage body 11, with the elastic grounding finger row 131 which is provided on the grounding member 13 which is the assembled-type and contacts the grounding pad of the circuit board, electromagnetic interference (EMI) effect of the metal shielding cage 1 can be enhanced, and under a precondition that the elastic grounding finger row 131 has better elasticity, the thickness and the strength of the cage body 11 of the metal shielding cage 1 are maintained. In the embodiment, the grounding member 13 and the back cover 12 are two members which are separated from each other and engaged with each other, the grounding member 13 is provided to a bottom side of the back cover 12 from the rear for example by welding, and the thickness of the metal plate forming the grounding member 13 is less than a thickness of a metal plate forming the back cover 12. Because the back cover 12 and the grounding member 13 which are in the assembled-type are two members which are separated from each other and engaged with each other, and the thickness of the metal plate forming the grounding member 13 is less than the thickness of the metal plate forming the back cover 12, similarly, under the precondition that the elastic grounding finger row 131 has better elasticity, the thickness and the strength of the back cover 12 can be maintained. But it is noted that, in a varied embodiment, the back cover 12 and the grounding member 13 also may be a configuration integrally formed, the present disclosure is not limited to the embodiment.

The back cover 12 has a rear covering plate 121 which covers the rear opening 114*b*, au upper covering plate 122 which extends forwardly from a top edge of the rear covering plate 121, and two side covering plates 123 which extend forwardly from two side edges of the rear covering plate 121 respectively and face each other in the left-right direction D3, the two side covering plates 123 respectively cover the two side walls 113 of the cage body 11, the upper covering plate 122 has an upper plate portion 122*a* which extends forwardly from the top edge of the rear covering plate 121 and covers the top wall 111 of the cage body 11 and two side plate portions 122*b* which extend downwardly from two side edges of the upper plate portion 122*a* respectively and face each other in the left-right direction D3, the two side plate portions 122*b* cover the two side walls 113 of the cage body 11 respectively. With the configuration of the upper covering plate 122 and the two side covering plates 123, an assembling area between the back cover 12 and the cage body 11 can be increased, so that the assembling strength between the back cover 12 and the cage body 11 is enhanced. Specifically, in the embodiment, front ends of the two side plate portions 122*b* of the upper covering plate 122 extend beyond the two side covering plates 123 and a distance between the two side plate portions 122*b* is less than a distance between the two side covering plates 123, and the upper covering plate 122 further has a plurality of first guiding edges 122*c* which extend from front edges of the upper plate portion 122*a* and the two side plate portions 122*b* in a manner of turning forwardly and outwardly, each side covering plate 123 further has a second guiding edge 123*a* which is positioned at a front edge of each side covering plate 123 and extend in a manner of turning forwardly and outwardly, in this way the back cover 12 is not easy to be blocked when the back cover 12 is assembled at the rear opening 114*b* of the cage body 11, it is beneficial for the back cover 12 to be assembled and more closely assembled to a rear end of the cage body 11. The cage body 11 further has a plurality of fixing bendable pieces 116 which extend rearwardly from rear edges of the two side walls 113, the back cover 12 is formed with a plurality of first through holes 124 at positions where the rear covering plate 121 and the two side covering plates 123 are connected so as to allow the fixing bendable pieces 116 to pass through, the fixing bendable pieces 116 pass through the first through holes 124, then bend inwardly and press against the rear covering plate 121 of the back cover 12 from the rear to fix the back cover 12 to the cage body 11. Moreover, the back cover 12 also is provided with a plurality of grounding legs 125 toward the mounting side 112, the plurality of grounding legs 125 are arranged to be space apart from each other and are used to be fixed on the circuit board.

The grounding member 13 includes a rear plate 132 which is provided to a bottom side of the rear covering plate 121 of the back cover 12 from the rear by for example welding and extends along the left-right direction D3 and two side plates 133 which extend forwardly from the rear plate 132 and are assembled to outer sides of the two side walls 113 of the cage body 11 respectively. Specifically, each side wall 113 has a plurality of inserting portions 113*a* which protrude outwardly and are arranged to be spaced apart from each other along the front-rear direction D1, each inserting portion 113*a* is formed with an inserting hole 113*b* which penetrates from the rear to the front, each side plate 133 has a plurality of inserting parts 133*a* which are recessed inwardly and engage with the inserting portions 113*a* respectively, each inserting part 133*a* has an inserting piece 133*b* which extends forwardly and inserts into the corresponding inserting hole 113*b* of the inserting portion 113*a*, with the above insertable-pullable configuration, assembling can be rapid and convenient. In addition, the grounding member 13 is formed with two second through holes 134 at positions where the rear plate 132 and the two side plates 133 are connected, the two second through holes 134 correspond to two of the first through holes 124 and allow the corresponding fixing bendable pieces 116 to pass through and function as fixing. The elastic grounding finger row 131 is connected to bottom edges of the rear plate 132 and the two side plates 133 toward the mounting side 112 and extends downwardly and outwardly, the elastic grounding finger row 131 is positioned at two lateral sides and a rear side of the bottom opening 112*b* of the cage body 11. Therefore the elastic grounding finger row 131 surrounds the receptacle connector from three sides, which increases the shielding effect around the receptacle connector. In addition, the elastic grounding finger row 131 is positioned outside the grounding legs 115, so the elastic grounding finger row 131 and the grounding legs 115 can generate a double-layer shielding effect, and because an arrangement density of the elastic grounding fingers 131*a* of the elastic grounding finger row 131 is larger than that of the grounding legs 115 arranged to space apart from each other, the shielding effect of the metal shielding cage 1 can be further significantly enhanced.

In conclusion, in the connector assembly 10 of the present disclosure, with the elastic grounding finger row 131 of the grounding member 13 which is the assembled-type, the electromagnetic interference (EMI) effect of the metal shielding cage 1 can be enhanced, and under a precondition that the elastic grounding finger row 131 has better elasticity, the thickness and the strength of the cage body 11 of the metal shielding cage 1 are maintained. Moreover, the back cover 12 and the grounding member 13 which are the assembled-type are two members which are separated from each other and engaged with each other, and the thickness of the metal plate forming the grounding member 13 is less than the thickness of the metal plate forming the back cover 12, similarly, under the precondition that the elastic grounding finger row 131 has better elasticity, the thickness and the strength of the back cover 12 can be maintained.

However, the above description is only for the embodiments of the present disclosure, and it is not intended to limit the implementing scope of the present disclosure, and the simple equivalent changes and modifications made according to the claims and the contents of the specification are still included in the scope of the present disclosure.

What is claimed is:

1. A connector assembly, comprising:

a metal shielding cage comprising a cage body, a back cover and a grounding member, the cage body having a top wall, a mounting side and two side walls, the top wall, the mounting side and the two side walls together defining a receiving space extending along a front-rear direction, the receiving space having a front opening toward the front and a rear opening positioned at the rear, the back cover and the grounding member being assembled at the rear opening of the cage body, and the grounding member being provided with an elastic grounding finger row toward the mounting side to elastically contact a grounding element of a circuit board.

2. The connector assembly of claim 1, wherein the grounding member and the back cover are two members which are separated from each other and engaged with each other, the grounding member is provided to a bottom side of the back cover, and a thickness of a metal plate forming the grounding member is less than a thickness of a metal plate forming the back cover.

3. The connector assembly of claim 2, wherein the grounding member comprises a rear plate and two side plates extending forwardly from the rear plate, the elastic grounding finger row is provided to bottom edges of the rear plate and the two side plates toward the mounting side.

4. The connector assembly of claim 3, wherein the mounting side of the cage body has a bottom wall positioned at the front and a bottom opening positioned at the rear, the elastic grounding finger row is positioned at two lateral sides and a rear side of the bottom opening.

5. The connector assembly of claim 4, wherein the two side walls and the back cover of the metal shielding cage are provided with a plurality of grounding legs toward the mounting side, the plurality of grounding legs are arranged to be spaced apart from each other, the elastic grounding finger row is positioned outside the plurality of grounding legs.

6. The connector assembly of claim 5 wherein the two side plates of the grounding member are assembled to outer sides of the two side walls of the cage body respectively, each side wall has a plurality of inserting portions protruding outwardly, each inserting portion is formed with an inserting hole from the rear to the front, each side plate has a plurality of inserting parts which are recessed inwardly and engage with the plurality of inserting portions respectively, each inserting part has an inserting piece which extends forwardly and inserts into the corresponding inserting hole of the inserting portion.

7. The connector assembly of claim 1, wherein the back cover has a rear covering plate provided on the rear opening, an upper covering plate which extends forwardly from a top edge of the rear covering plate and two side covering plates which extend forwardly from two side edges of the rear covering plate respectively, the upper covering plate has an upper plate portion which extends forwardly from the top edge of the rear covering plate and two side plate portions which extend downwardly from two side edges of the upper plate portion respectively.

8. The connector assembly of claim 7, wherein the upper covering plate further has guiding edges which extend from front edges of the upper plate portion and the two side plate portions in a manner of turning forwardly and outwardly.

9. The connector assembly of claim 8, wherein front ends of the two side plate portions of the upper covering plate extend beyond the two side covering plates, and a distance between the two side plate portions of the upper covering plate is less than a distance between the two side covering plates.

10. The connector assembly of claim 9, wherein each side covering plate further has a guiding edge which is positioned at a front edge of each side covering plate and extends in a manner of turning forwardly and outwardly.

11. The connector assembly of claim 3, wherein the elastic grounding finger row extends downwardly and outwardly from the bottom edges of the rear plate and the bottom edges of the two side plates.

12. The connector assembly of claim 1, wherein the two side walls and the back cover of the metal shielding cage are provided with a plurality of grounding legs toward the mounting side, wherein the plurality of grounding legs are arranged to be spaced apart from each other at a first density, wherein the elastic grounding finger row is arranged outside the plurality of grounding legs at a second density, and wherein the second density of the elastic grounding fingers is larger than that of the first density of the grounding legs.

* * * * *